US010107050B2

(12) United States Patent
Williamson, Jr. et al.

(10) Patent No.: US 10,107,050 B2
(45) Date of Patent: Oct. 23, 2018

(54) PRESSURE EQUALIZATION APPARATUS AND ASSOCIATED SYSTEMS AND METHODS

(71) Applicant: HALLIBURTON ENERGY SERVICES, INC., Houston, TX (US)

(72) Inventors: Jimmie R. Williamson, Jr., Carrollton, TX (US); James D. Vick, Jr., Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 652 days.

(21) Appl. No.: 14/669,214

(22) Filed: Mar. 26, 2015

(65) Prior Publication Data

US 2015/0233191 A1 Aug. 20, 2015

Related U.S. Application Data

(62) Division of application No. 13/085,075, filed on Apr. 12, 2011, now Pat. No. 9,016,387.

(51) Int. Cl.
*E21B 17/18* (2006.01)
*E21B 34/06* (2006.01)
(Continued)

(52) U.S. Cl.
CPC ..... *E21B 17/18* (2013.01); *E21B 33/10* (2013.01); *E21B 34/06* (2013.01); *E21B 47/011* (2013.01)

(58) Field of Classification Search
CPC ..... E21B 17/18; E21B 33/10; E21B 34/06; E21B 34/066; E21B 47/011; E21B 34/00; E21B 2034/005
See application file for complete search history.

(56) References Cited

U.S. PATENT DOCUMENTS 2,556,435 A 6/1951 Moehrl et al.
3,980,369 A 9/1976 Panek
(Continued)

FOREIGN PATENT DOCUMENTS

GB 2395071 A 5/2004
WO 9730269 A1 8/1997

OTHER PUBLICATIONS

International Preliminary Report on Patentability dated Mar. 17, 2011 for International Patent Application Serial No. PCT/US09/55187, 5 pages.
(Continued)

*Primary Examiner* — Yong-Suk Ro
(74) *Attorney, Agent, or Firm* — Locke Lord LLP; Joseph A. Farco; Joshua L. Jones

(57) ABSTRACT

A pressure equalization apparatus can include separate longitudinal bores which form a continuous flowpath, the flowpath alternating direction between the bores, and the bores being interconnected at opposite ends thereof. A well system can include a well tool with a chamber therein containing an assembly in a dielectric fluid, and a pressure equalization apparatus including a flowpath having one end connected to the chamber, and the other end connected to a source of a another fluid, the flowpath extending in opposite directions between the flowpath ends through multiple separate bores. A method of installing a well tool can include attaching a mandrel to the well tool, then lowering the well tool at least partially into the well suspended from the mandrel, and then securing a pressure equalization apparatus to the mandrel, a flowpath of the apparatus being connected to a chamber of the well tool containing an assembly.

15 Claims, 15 Drawing Sheets

(51) Int. Cl.
*E21B 47/01* (2012.01)
*E21B 33/10* (2006.01)

(56) References Cited

U.S. PATENT DOCUMENTS

| | | | |
|---|---|---|---|
| 4,537,457 | A | 8/1985 | Davis, Jr. et al. |
| 4,598,773 | A | 7/1986 | Pringle |
| 4,700,272 | A | 10/1987 | Bellamy |
| 4,976,317 | A | 12/1990 | Leismer |
| 5,038,865 | A | 8/1991 | Taylor et al. |
| 5,058,682 | A | 10/1991 | Pringle |
| 5,310,004 | A | 5/1994 | Leismer |
| 5,320,182 | A | 6/1994 | Mendez |
| 5,795,135 | A | 8/1998 | Nyilas et al. |
| 5,918,688 | A | 7/1999 | Evans |
| 5,947,206 | A | 9/1999 | Mccalvin et al. |
| 6,012,518 | A | 1/2000 | Pringle et al. |
| 6,041,857 | A | 3/2000 | Carmody et al. |
| 6,059,539 | A | 5/2000 | Nyilas et al. |
| 6,063,001 | A | 5/2000 | Suhling et al. |
| 6,179,055 | B1 | 1/2001 | Sallwasser et al. |
| 6,250,387 | B1 | 6/2001 | Carmichael et al. |
| 6,269,874 | B1 | 8/2001 | Rawson et al. |
| 6,293,346 | B1 | 9/2001 | Patel |
| 6,310,829 | B1 | 10/2001 | Green et al. |
| 6,364,023 | B1 | 4/2002 | Hiron et al. |
| 6,367,545 | B1 | 4/2002 | Van Buskirk et al. |
| 6,440,033 | B1 | 8/2002 | Suhling et al. |
| 6,450,258 | B2 | 9/2002 | Green et al. |
| 6,575,236 | B1 | 6/2003 | Heijnen |
| 6,602,059 | B1 | 8/2003 | Howell et al. |
| 6,619,388 | B2 | 9/2003 | Dietz et al. |
| 6,688,860 | B2 | 2/2004 | Du et al. |
| 6,978,842 | B2 | 12/2005 | Read, Jr. et al. |
| 6,981,853 | B2 | 1/2006 | Du et al. |
| 7,168,492 | B2 | 1/2007 | Laplante et al. |
| 7,217,107 | B2 | 5/2007 | Du et al. |
| 7,219,752 | B2 | 5/2007 | Wassell et al. |
| 7,373,983 | B2 | 5/2008 | Mcgavern, III et al. |
| 7,378,769 | B2 | 5/2008 | Head |
| 7,434,626 | B2 | 10/2008 | Vick, Jr. |
| 7,635,029 | B2 | 12/2009 | Macdougall et al. |
| 7,640,989 | B2 | 1/2010 | Williamson, Jr. et al. |
| 7,673,705 | B2 | 3/2010 | Gearhart et al. |
| 7,828,056 | B2 * | 11/2010 | Dybevik ..... E21B 43/08 166/236 |
| 2002/0108747 | A1 | 8/2002 | Dietz et al. |
| 2002/0192090 | A1 | 12/2002 | Du et al. |
| 2004/0136849 | A1 | 7/2004 | Du et al. |
| 2006/0118304 | A1 | 6/2006 | Ohmer |
| 2007/0084601 | A1 | 4/2007 | Wang et al. |
| 2007/0284117 | A1 | 12/2007 | Smithson |
| 2008/0053662 | A1 | 3/2008 | Williamson et al. |
| 2010/0051260 | A1 | 3/2010 | Vick, Jr. et al. |
| 2010/0147064 | A1 | 6/2010 | Difoggio |
| 2011/0024111 | A1 | 2/2011 | Moen et al. |
| 2012/0103619 | A1 | 5/2012 | Schroeder et al. |
| 2012/0261139 | A1 | 10/2012 | Williamson, Jr. et al. |
| 2013/0105149 | A1 | 5/2013 | Williamson, Jr. et al. |

OTHER PUBLICATIONS

International Search Report and Written Opinion dated Oct. 13, 2009, for International Patent Application Serial No. PCT/US09/055187, 6 pages.

Office Action dated Feb. 18, 2010 for U.S. Appl. No. 12/204,346, 12 Pages.

Office Action dated Jun. 30, 2010 for U.S. Appl. No. 12/204,346, 8 Pages.

International Search Report with Written Opinion dated Sep. 25, 2012 for PCT Patent Application No. PCT/US11/066514, 14 pages.

International Search Report with Written Opinion dated Oct. 25, 2012 for PCT Patent Application No. PCT/US12/030669, 11 pages.

Office Action dated Apr. 26, 2013 for U.S. Appl. No. 13/742,886, 13 pages.

Office Action dated Apr. 26, 2013 for U.S. Appl. No. 13/718,951, 16 pages.

Office Action dated Oct. 9, 2013 for U.S. Appl. No. 13/742,886, 18 pages.

Office Action dated Sep. 19, 2013 for U.S. Appl. No. 13/085,075, 37 pages.

Office Action dated Apr. 23, 2014 for U.S. Appl. No. 13/085,075, 9 pages.

Extended European Search Report Patent Application No. 12771568.8-1605/2697474 dated Dec. 15, 2015.

* cited by examiner

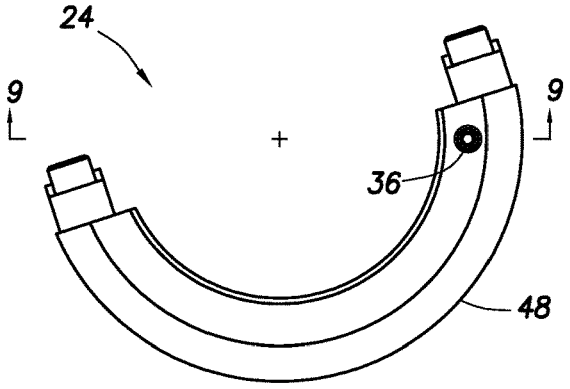
FIG.8
FIG.9A
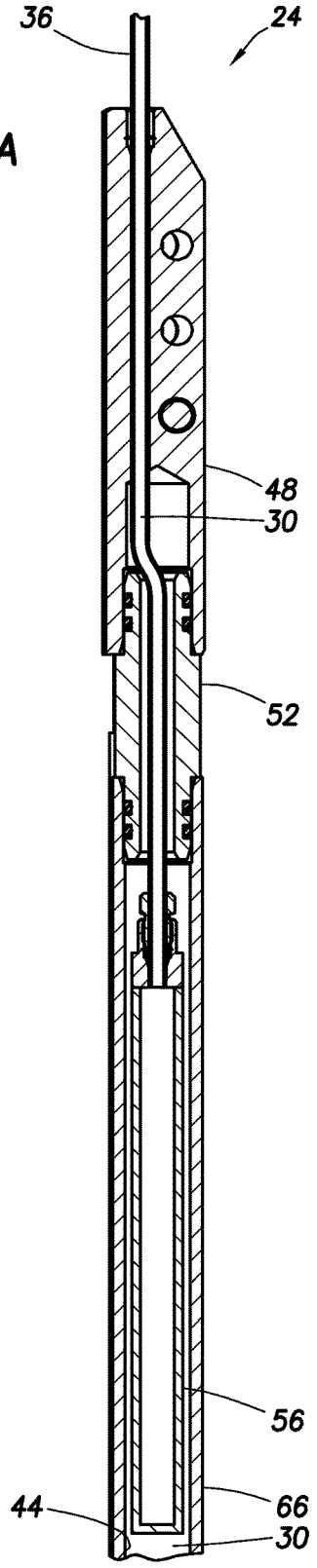

PRESSURE EQUALIZATION APPARATUS AND ASSOCIATED SYSTEMS AND METHODS

CROSS-REFERENCE TO RELATED APPLICATION

This application is a division of prior application Ser. No. 13/085,075, filed on 12 Apr. 2011. The entire disclosure of this prior application is incorporated herein by this reference.

BACKGROUND

This disclosure relates generally to equipment utilized and operations performed in conjunction with a subterranean well and, in an example described below, more particularly provides a pressure equalization apparatus and associated systems and methods.

In some circumstances, it is desirable to isolate part of a well tool from a surrounding well environment, but without there being a pressure differential created between the well environment and the isolated part of the well tool. Thus, both fluid isolation and pressure equalization are needed in these circumstances. It will be appreciated that there is a continual need for improvements in the art of constructing pressure equalization devices for use with well tools.

SUMMARY

In the disclosure below, a pressure equalization apparatus is provided which brings improvements to the art. One example is described below in which multiple separate bores are combined to form a continuous flowpath. Another example is described below in which the bores are formed through respective separate tubes.

In one aspect, a pressure equalization apparatus described below is for use with a well tool in a subterranean well. The apparatus can include multiple separate longitudinally extending bores which form a continuous flowpath, the flowpath alternating direction between the bores, and the bores being interconnected at opposite ends thereof.

In another aspect, a well system described below can include a well tool including a chamber therein containing an assembly in a dielectric first fluid. A pressure equalization apparatus in the well system can include a flowpath having opposite ends, one end being connected to the chamber, the other end being connected to a source of a second fluid, with the flowpath extending in alternating opposite directions between the opposite ends through multiple separate bores.

In yet another aspect, a method of installing a well tool in a well can include attaching a mandrel to the well tool, then lowering the well tool at least partially into the well suspended from the mandrel, and then securing a pressure equalization apparatus to the mandrel, a flowpath of the apparatus being connected to a chamber of the well tool containing an assembly.

These and other features, advantages and benefits will become apparent to one of ordinary skill in the art upon careful consideration of the detailed description of representative examples below and the accompanying drawings, in which similar elements are indicated in the various figures using the same reference numbers.

BRIEF DESCRIPTION OF THE DRAWINGS

FIG. 8 is a representative end view of another configuration of the pressure equalization apparatus.

DETAILED DESCRIPTION

Figure 1:
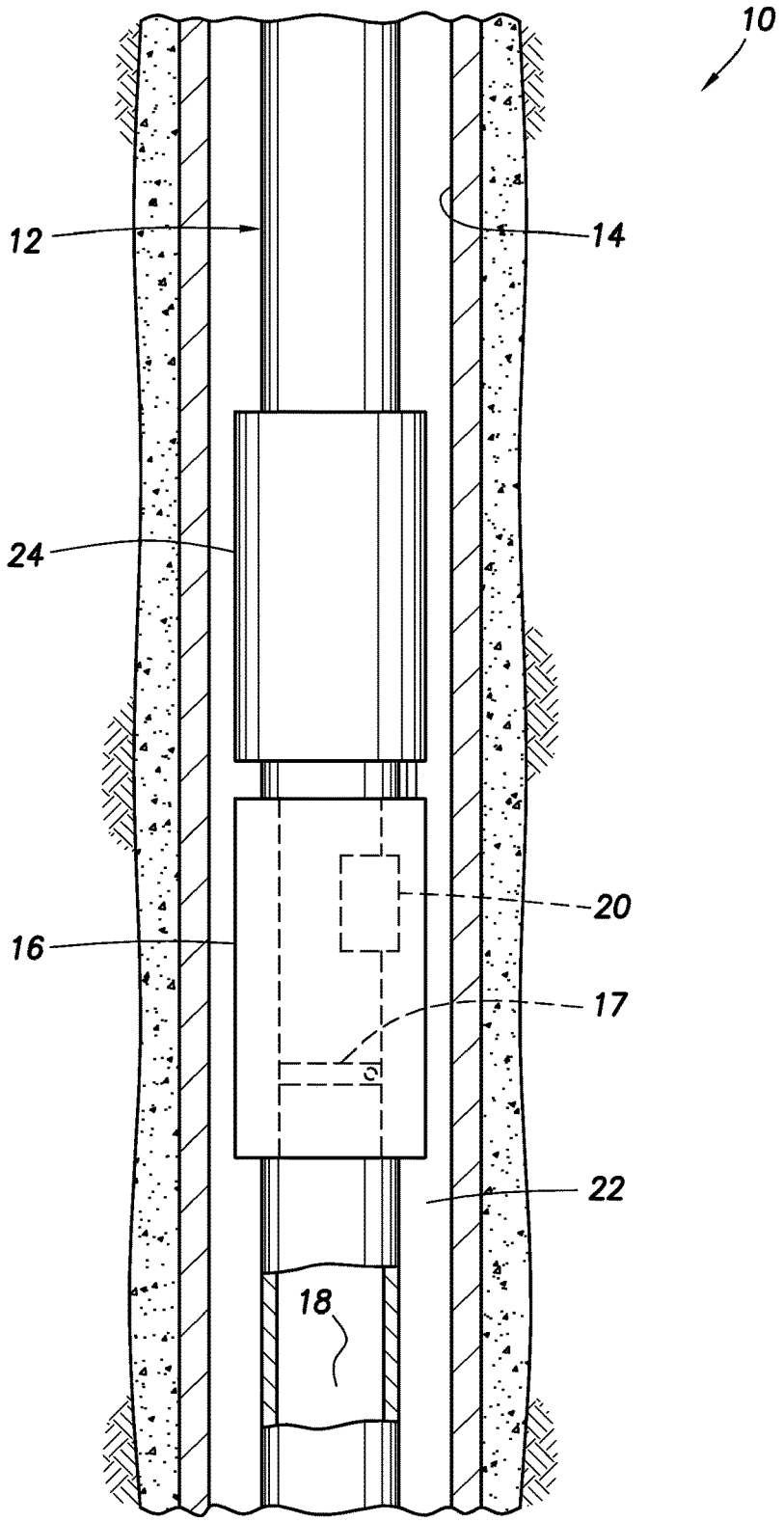
FIG. 1 is a representative partially cross-sectional view of a well system and associated method which can embody principles of this disclosure.

Representatively illustrated in FIG. 1 is a well system 10 and associated method which can embody principles of this disclosure. As depicted in FIG. 1, a tubular string 12 is positioned in a wellbore 14. A well tool 16 is interconnected in the tubular string 12.

The well tool 16 could be any type of well tool, such as a flow control device (e.g., a production valve, safety valve, choke, injection control valve, etc.), sensor, telemetry device, etc., or any combination of well tools. Representatively, in this example the well tool 16 is a safety valve for selectively permitting and preventing flow through an internal longitudinal flow passage 18 of the tubular string 12 (e.g., utilizing a closure device 17, such as a flapper or ball, to close off the flow passage).

A chamber 20 is positioned within the well tool 16. It is desired in the well system 10 to maintain equal pressure between the chamber 20 and either the flow passage 18 or an annulus 22 formed radially between the tubular string 12 and the wellbore 14. For this purpose, a pressure equalization apparatus 24 is interconnected between the chamber 20 and the passage 18 or annulus 22.

The apparatus 24 is used to equalize pressure, while also preventing fluid in the passage 18 or annulus 22 from entering the chamber 20. For example, the chamber 20 could contain equipment which could be damaged or rendered inoperative by the fluid in the passage 18 or annulus 22.

Figure 2:
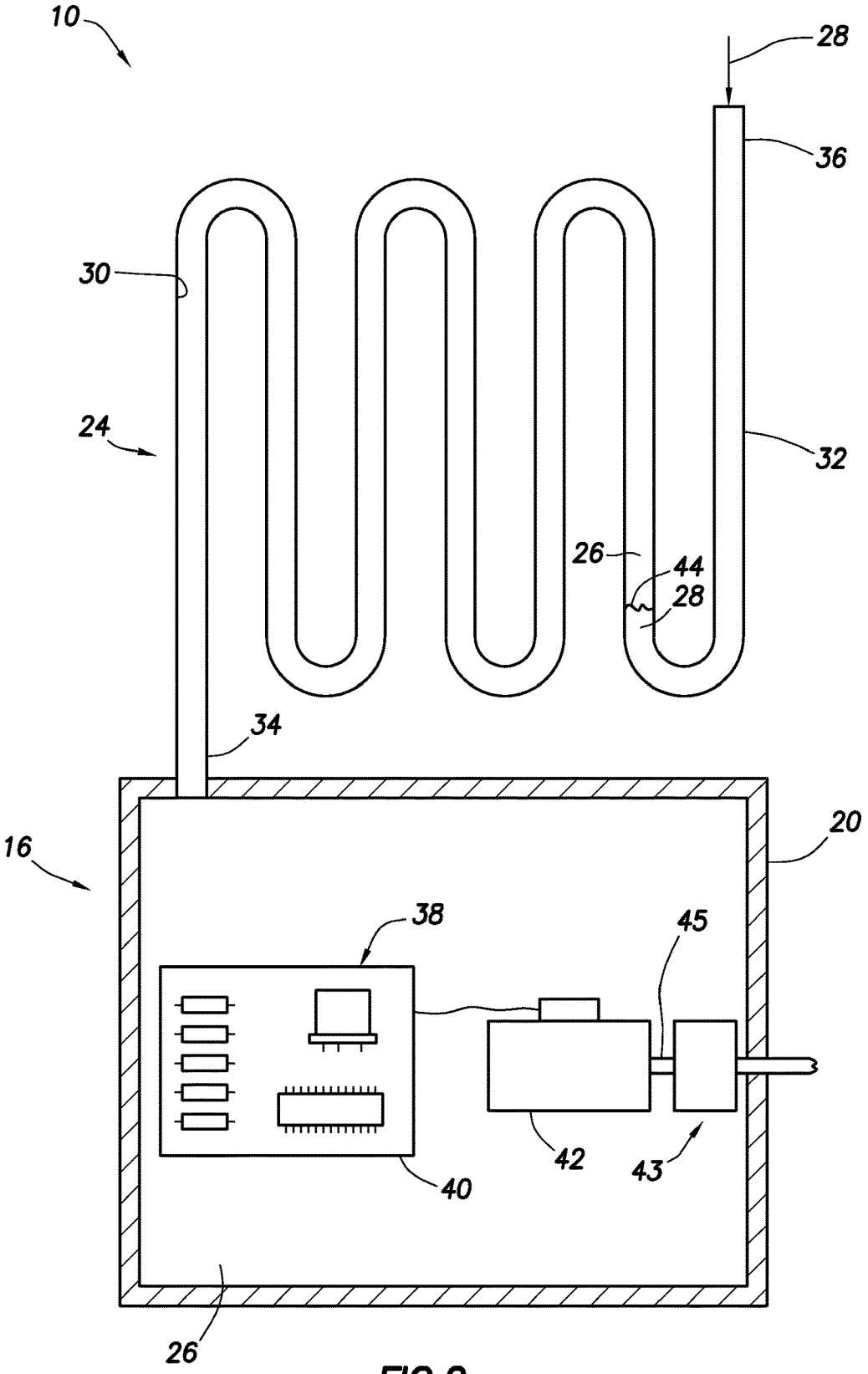
FIG. 2 is a representative illustration of a pressure equalization apparatus and a well tool which may be used in the well system and method.

Referring additionally now to FIG. 2, an enlarged scale schematic view of the well tool 16 and pressure equalization apparatus 24 is representatively illustrated, apart from the remainder of the well system 10. In this view it may be seen that the chamber 20 contains one fluid 26 which almost completely fills a flowpath 30 within a tube 32 of the apparatus 24. Another fluid 28 is introduced from a fluid source (such as, the passage 18 or annulus 22, etc.).

One end 34 of the flowpath 30 is connected to the chamber 20, and an opposite end 36 of the flowpath is connected to the source of the fluid 28. Between the ends 34 and 36 of the flowpath 30, the flowpath extends alternately upward and downward.

In this example, an electrical assembly 38 (e.g., including an electronic circuit 40 and an electrical motor 42, for example, to operate the closure device 17) is positioned in the chamber 20, and the fluid 26 is a dielectric fluid used to insulate about the assembly and provide for heat transfer while transmitting pressure to avoid high pressure differentials across the walls of the chamber. The fluid 28, in contrast, may be a well fluid which is corrosive and/or conductive, and which could damage the assembly 38, or at least render it inoperative.

A mechanical assembly 43 (such as shaft 45, rods, magnets, springs, etc.) may also, or alternatively, be protected in the chamber 20 from the fluid 28. If only the mechanical assembly 43 is in the chamber 20, then the fluid 26 is not necessarily a dielectric fluid, but it is preferably at least a clean fluid to prevent damage, wear, binding, etc. of the mechanical assembly 43.

Note that the apparatus 24 permits pressure to be transmitted through the flowpath 30, but prevents the fluid 28 from migrating to the end 34 of the flowpath and into the chamber 20. Because of the upward and downward undulations of the flowpath 30 between its opposite ends 34, 36, the fluid 28 would have to flow alternately upward and downward multiple times in order to migrate from the end 36 to the end 34.

However, since the fluids 26, 28 preferably have different densities, only one such upward or downward flow of the fluid 28 is to be expected as a result of the different fluid densities and the force of gravity acting on the fluids. The fluid 28 may flow somewhat further into the flowpath 30 due to transmission of pressure from the fluid source (e.g., flow passage 18 or annulus 22) to the chamber 20, but an interface 44 between the fluids 26, 28 is expected to remain in the tube between the opposite ends 34, 36.

The flowpath 30 can also provide a conduit for extending a line (such as an electrical or fiber optic line) into the chamber 20. This feature eliminates the need for any additional penetrations of the wall of the chamber 20, for example, to provide power and/or data communication for the assembly 38.

Figure 3A:
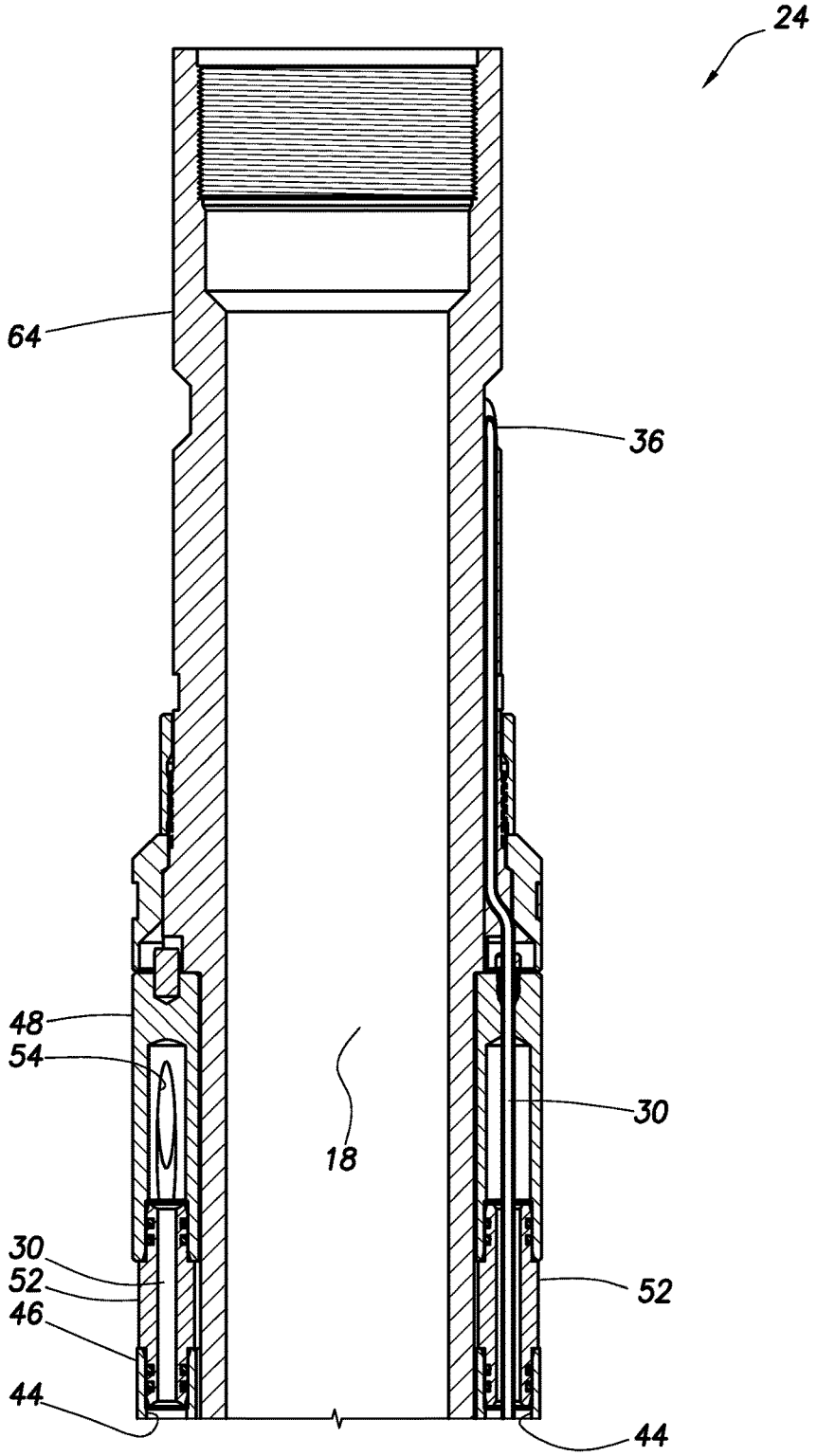
FIGS. 3A-C are representative cross-sectional views of a pressure equalization apparatus which can embody principles of this disclosure.
Figure 3B:
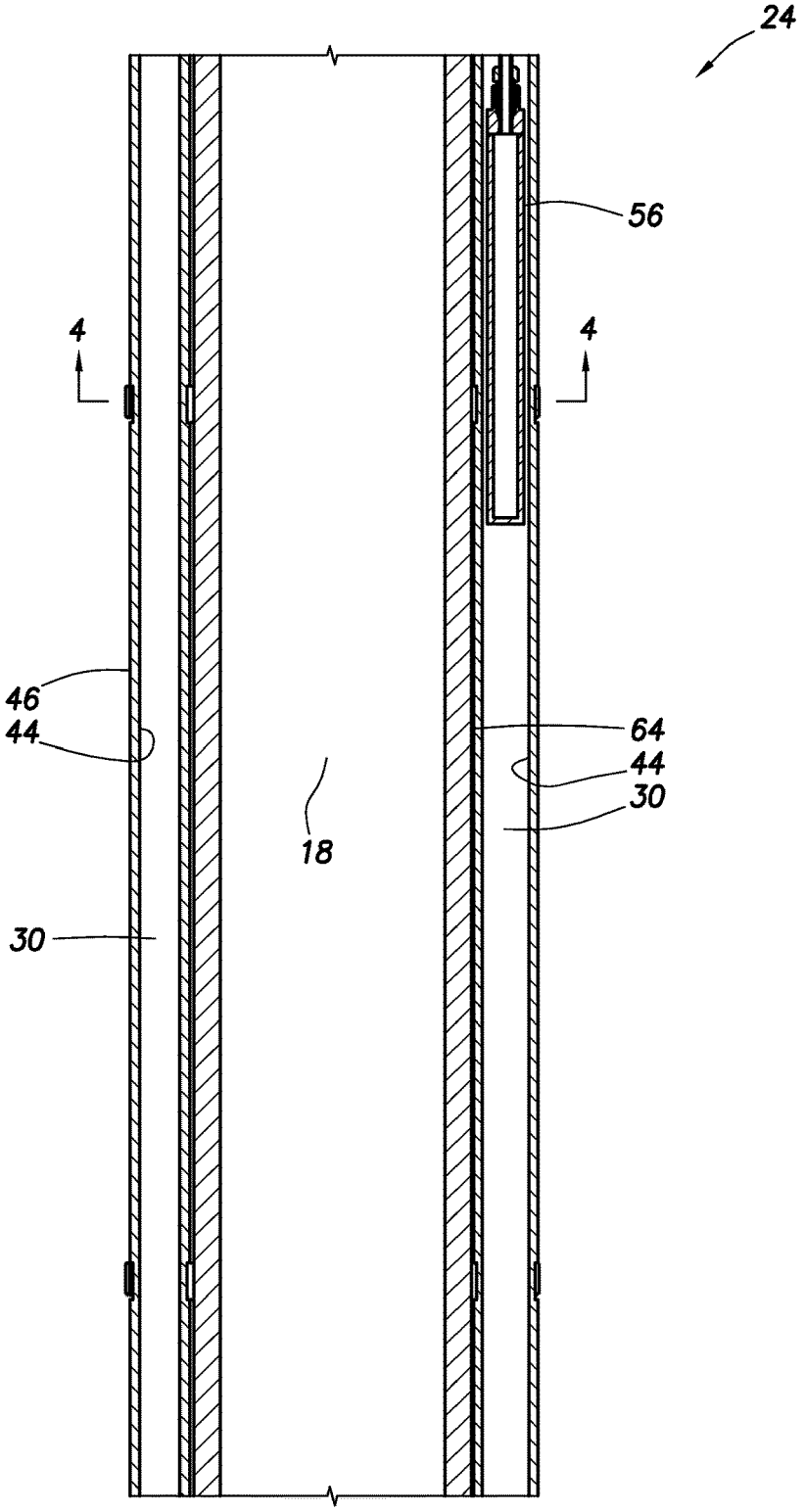
Figure 3C:
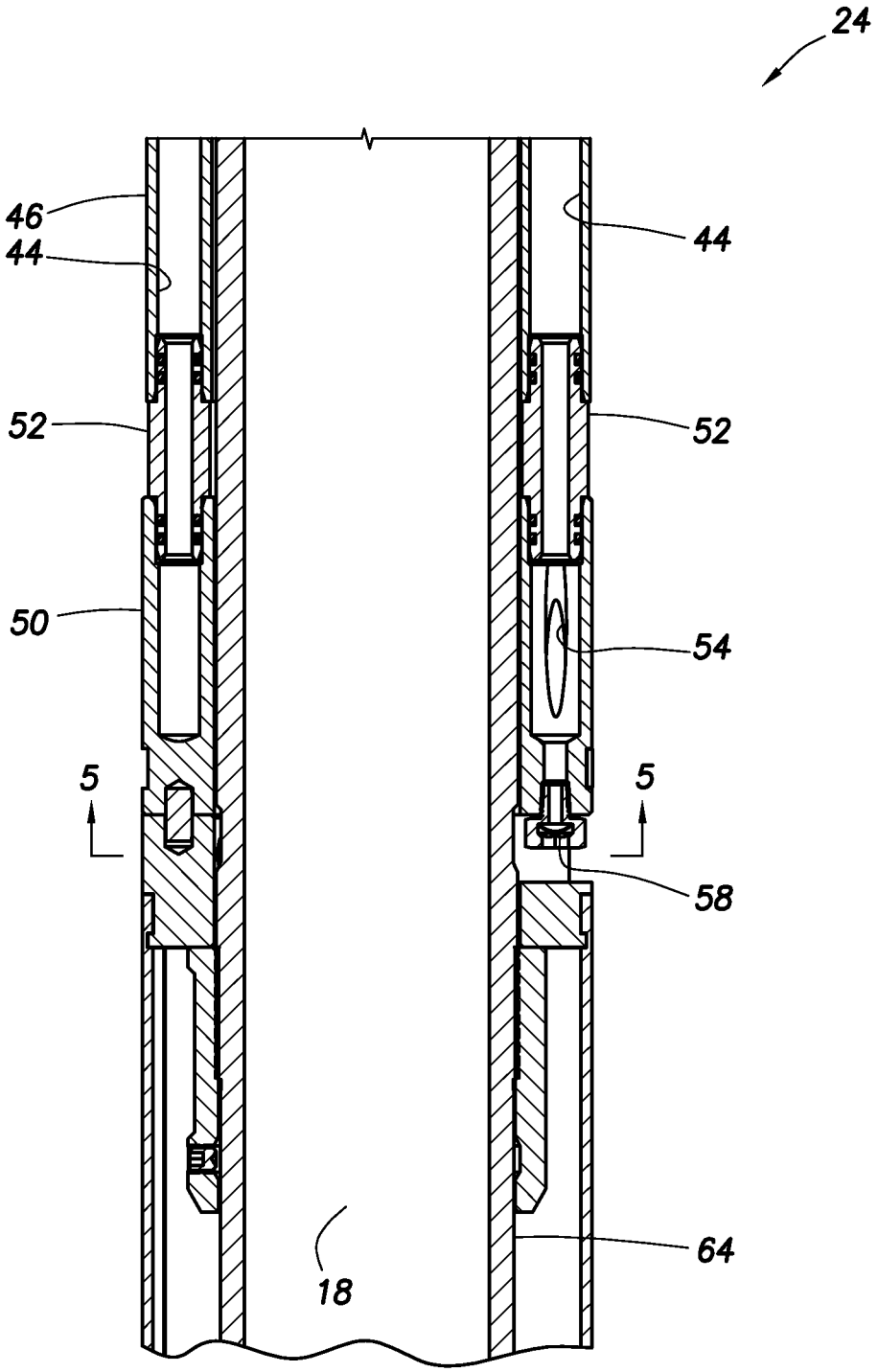

Referring additionally now to FIGS. 3A-C more detailed cross-sectional views of one example of the pressure equalization apparatus 24 is representatively illustrated. As with other configurations of the pressure equalization apparatus 24 described herein and depicted in the drawings, the example shown in FIGS. 3A-C may be used in the well system 10 of FIG. 1, or it may be used in other well systems. Therefore, it should be clearly understood that the principles of this disclosure are not limited at all to any of the details of the well system 10 as described above or depicted in the drawings.

Figure 4:
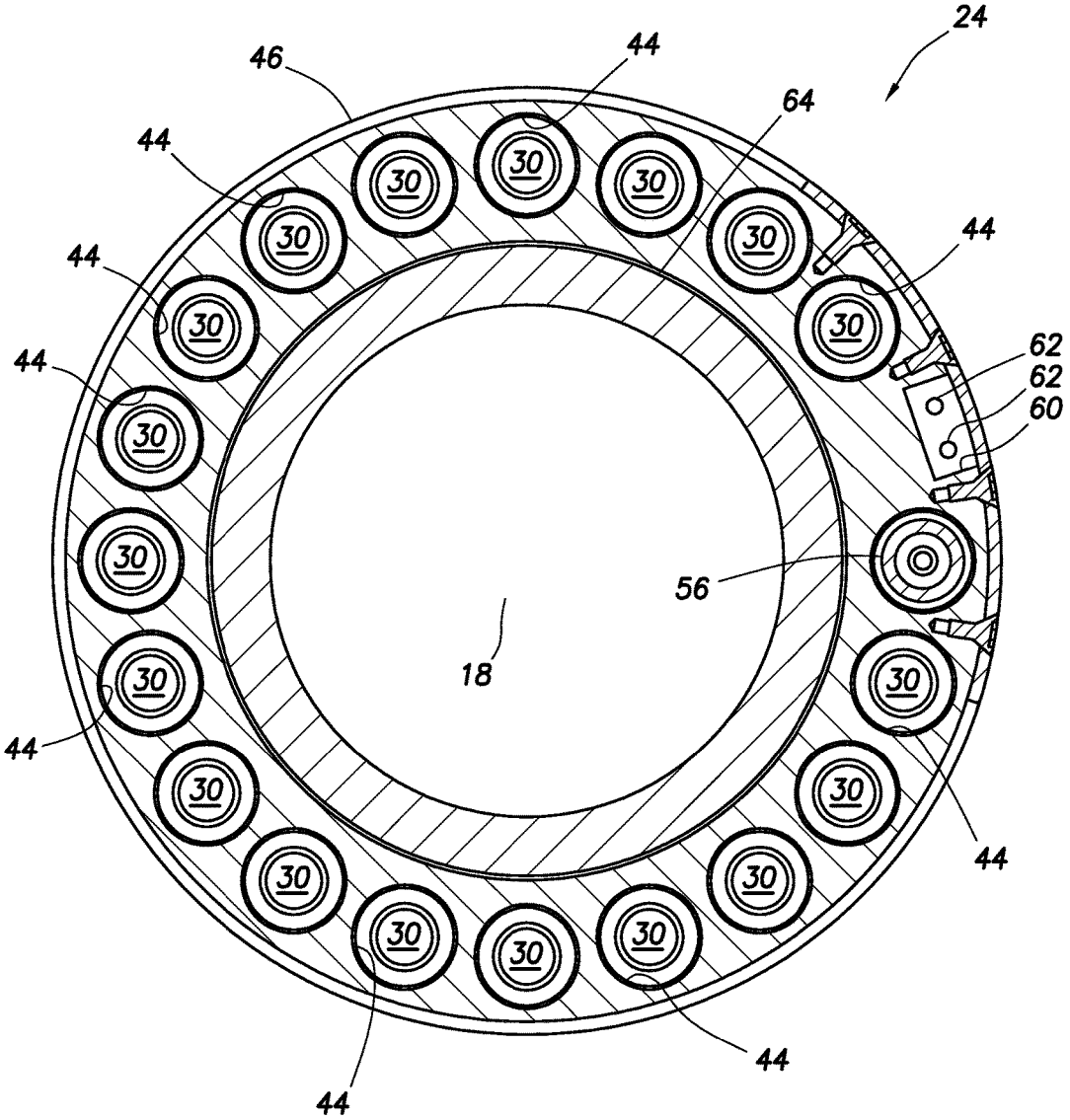
FIG. 4 is a representative cross-sectional view of the pressure equalization apparatus, taken along line 4-4 of FIG. 3B.

The pressure equalization apparatus 24 configuration of FIGS. 3A-C includes multiple bores 44 formed longitudinally through a generally tubular structure 46. As may be seen in the enlarged cross-sectional view of FIG. 4, the bores 44 are circumferentially spaced apart in the structure 46.

End closures 48, 50 at opposite ends of the structure 46 are connected to the bores 44 by connectors 52. The end closures 48, 50 have passages 54 formed therein which connect adjacent pairs of the bores.

The passages 54 connect adjacent pairs of the bores 44 alternating between the end closures 48, 50, so that the flowpath 30 extends in opposite directions, back and forth, through the bores in succession. The flowpath 30 reverses direction in the passages 54 of the end closures 48, 50.

A filter 56 is positioned in one of the bores 44 which is connected to the flowpath end 36. The fluid 28 enters the end 36 and is filtered by the filter 56. The bores 44 are preferably filled with the fluid 26 prior to the apparatus 24 being installed in the wellbore 14, and so it is expected that the fluid 28 will not migrate far into the flowpath 30, and will not traverse more than one of the reversals of direction of the flowpath in the end closures 48, 50.

The relatively large diameter bores 44 provide for a substantial volume of the fluid 26, and provide an almost instantaneous equalization of pressure between the chamber 20 and the source of the fluid 28. Especially in situations where one or more walls of the chamber 20 cannot sustain significant pressure differentials, this ability to immediately equalize pressure across the walls of the chamber can be vital to successful operation of the well tool 16.

In FIG. 3C it may be seen that a rupture disc 58 is installed in the lower end closure 50, aligned with a lower end of the bore 44 in which the filter 56 is positioned. The rupture disc 58 allows fluid communication to be established with the flowpath 30, even if the filter 56 or the end 36 of the flowpath becomes plugged.

If the end 36 of the flowpath 30 is connected to the annulus 22, then the chamber 20 is pressure equalized with the annulus. However, if the filter 56 becomes plugged, this pressure equalization suffers. By opening the rupture disc 58 (e.g., by increasing pressure in the annulus 22 until the rupture disc ruptures), communication between the flowpath 30 and the annulus can be reestablished.

Figure 5:
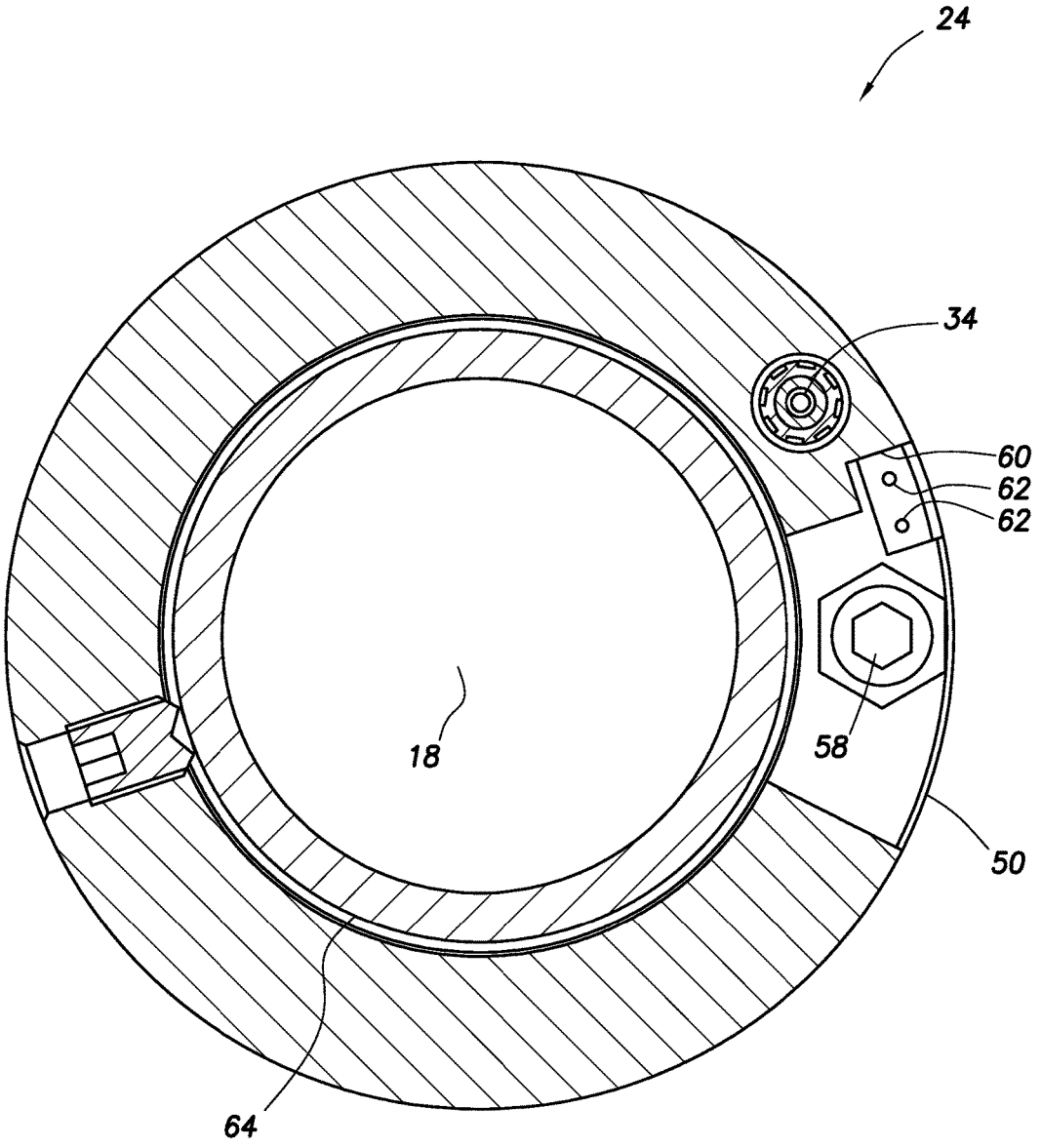
FIG. 5 is a representative cross-sectional view of the pressure equalization apparatus, taken along line 5-5 of FIG. 3C.

In FIG. 5 it may be seen that the end 34 of the flowpath 30 exits the lower end closure 50. The end 34 is connected in the end closure 50 to the last bore 44 in the sequence of bores starting with the one connected to the end 36, and then proceeding clockwise as viewed in FIG. 4.

A longitudinal recess 60 formed between the first and last bores 44 in this sequence provides space for lines 62 to extend longitudinally along the apparatus 24. The lines 62 could be, for example, electrical, hydraulic, optical or other types of lines, and could be used for controlling operation of, and/or providing power to, the well tool 16 (e.g., connecting to the electrical assembly 38).

The structure 46 and end closures 48, 50 are carried on and secured to a generally tubular mandrel 64. The mandrel 64 can be provided with threads at its opposite ends for interconnecting the apparatus 24 in the tubular string 12. In another configuration described below, the mandrel 64 can also be used for conveying the well tool 16 into an upper end of the wellbore 14.

Figure 6A:
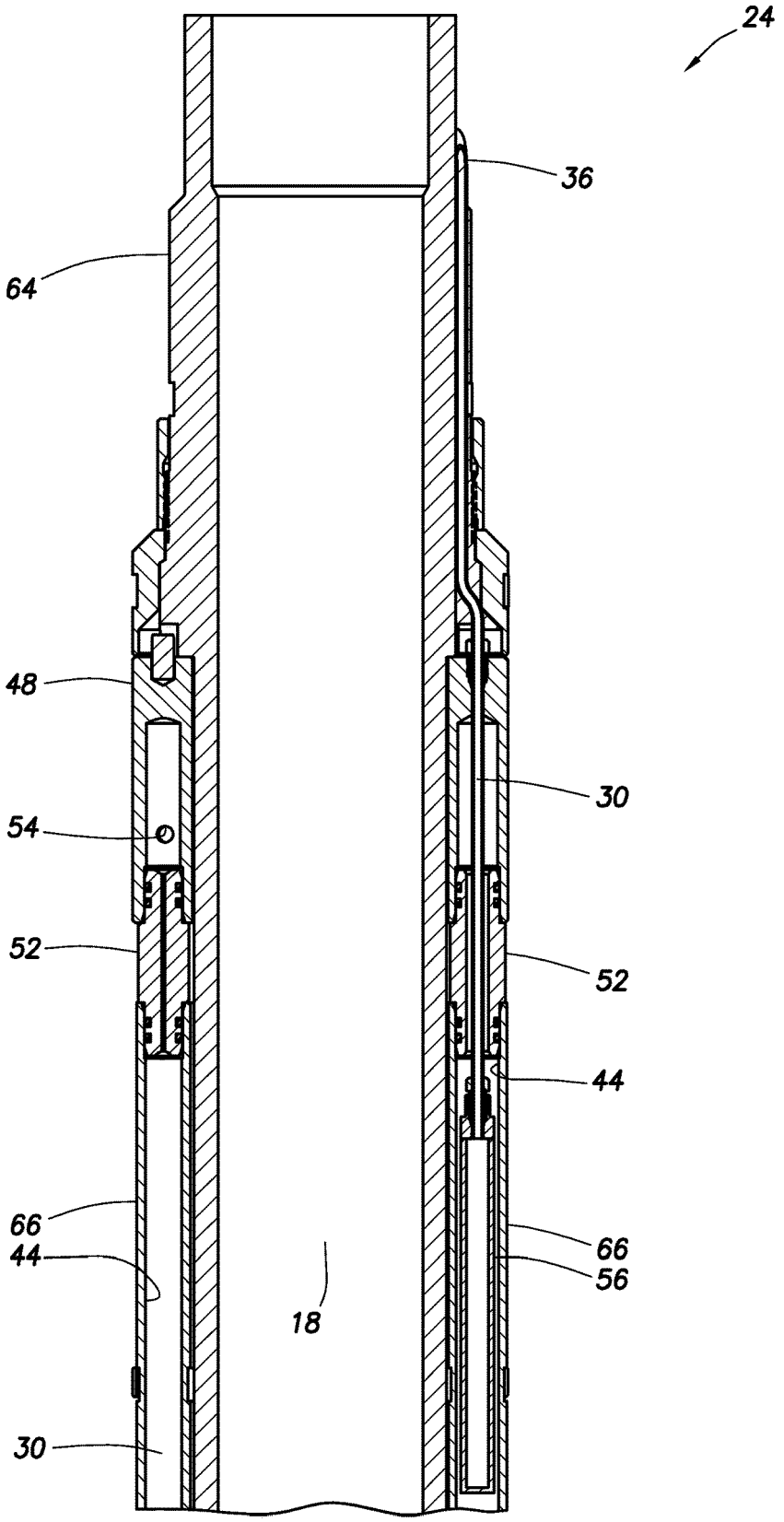
FIGS. 6A & B are representative cross-sectional views of another configuration of the pressure equalization apparatus.

Referring additionally now to FIGS. 6A & B, opposite ends of another configuration of the pressure equalization apparatus 24 are representatively illustrated. The configuration of FIGS. 6A & B is similar in many respects to the configuration of FIGS. 3A-5, but differs at least in that, instead of forming the bores 44 in the structure 46, the bores in the FIGS. 6A & B configuration are formed in separate tubes 66.

Figure 7:
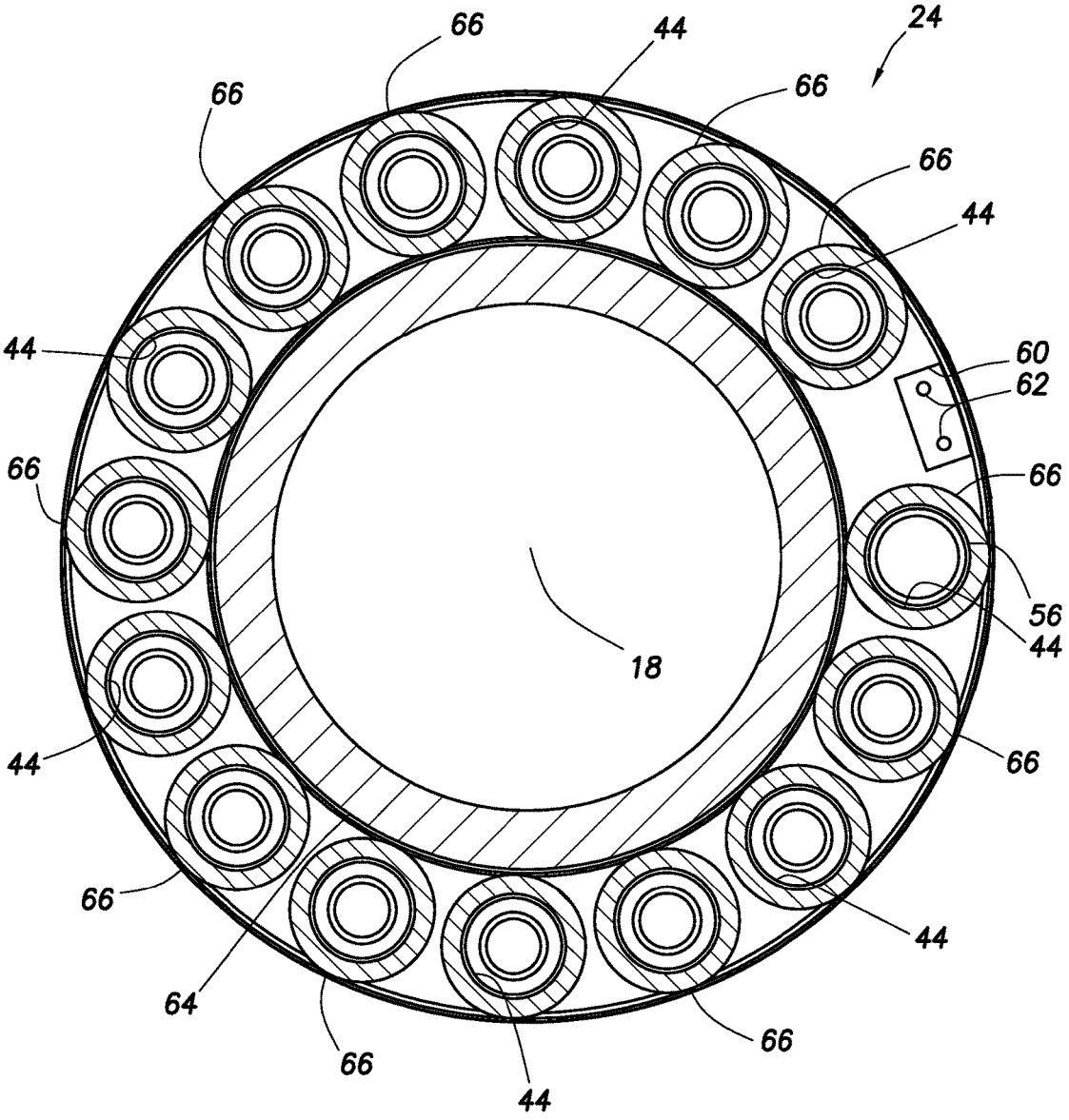
FIG. 7 is a representative cross-sectional view of the pressure equalization apparatus, taken along line 7-7 of FIG. 6B.

The manner in which the tubes 66 are circumferentially distributed about the mandrel 64 can be seen in FIG. 7. Note that the bores 44 are circumferentially spaced apart from each other, similar to the configuration shown in FIG. 4.

The apparatus 24 configuration of FIGS. 6A & B functions in a manner similar to that of the configuration of FIGS. 3A-C, in that the flowpath 30 extends in alternating opposite directions through the bores 44, and reverses direction in the end closures 48, 50 at the opposite ends of the tubes 66.

Figure 6B:
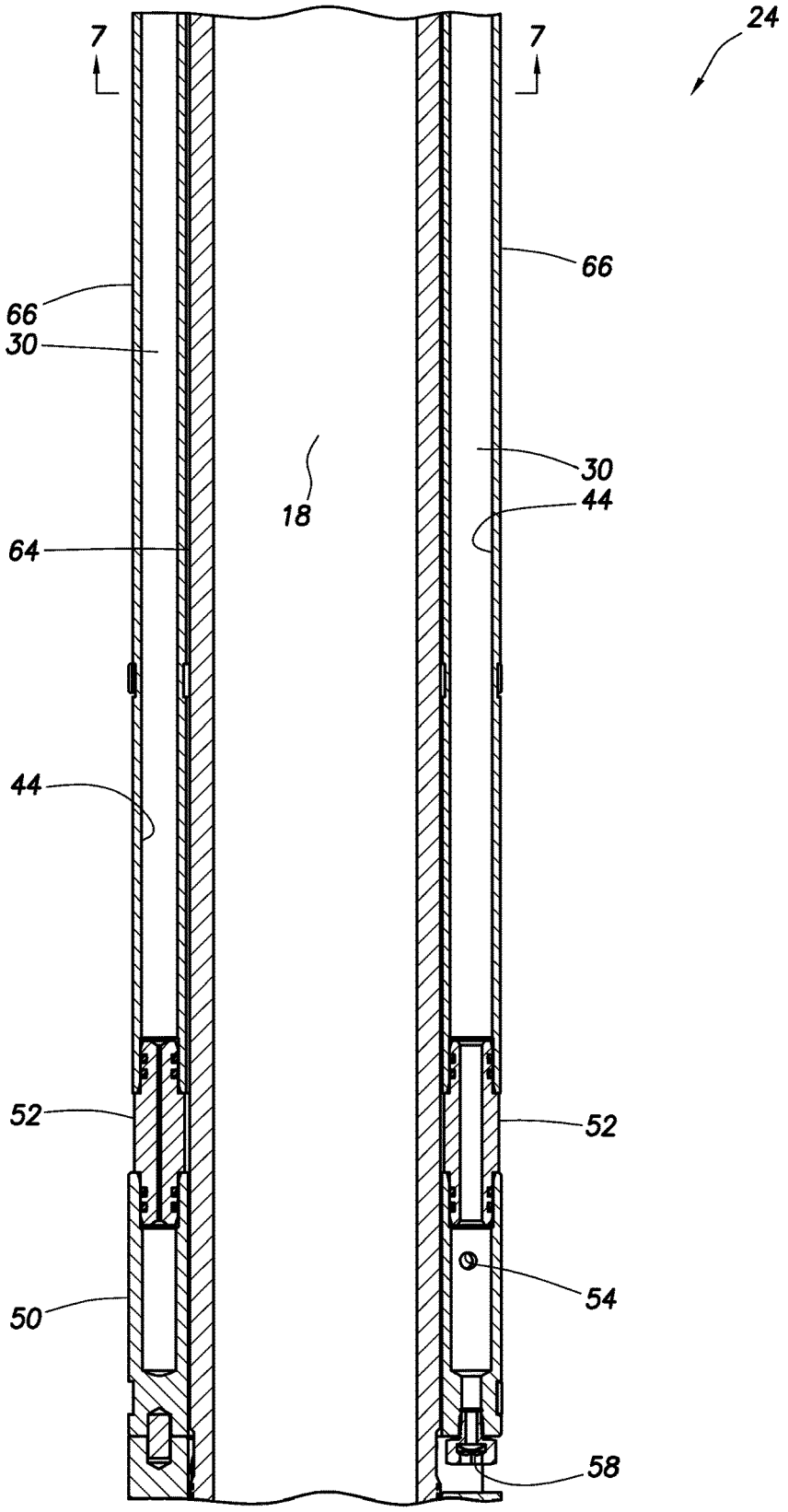

Referring additionally now to FIGS. 8-11B, yet another configuration of the pressure equalization apparatus 24 is representatively illustrated. The configuration of FIGS. 8-11B is similar in many respects to the configuration of FIGS. 6A-7, but differs at least in that the end closures 48, 50, tubes 66 and connectors 52 do not extend completely circumferentially about the mandrel 64.

As depicted in FIG. 8 (an end view of the apparatus 24), the end closure 48 has a semi-circular shape. The other end closure 50 in this example has the same semi-circular shape, and the tubes 66 and connectors 52 are only partially circumferentially distributed about the mandrel 64 when the apparatus 24 is fully assembled.

Figure 9B:
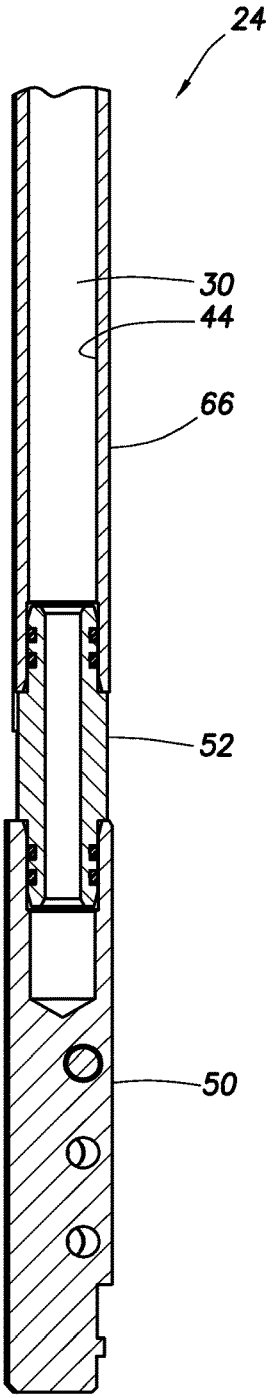
FIGS. 9A & B are representative cross-sectional views of the pressure equalization apparatus, taken along line 9-9 of FIG. 8.

In FIGS. 9A & B, cross-sectional views of opposite ends of the apparatus 24 are representatively illustrated. In these views it may be seen that the construction of the FIGS. 8-11B configuration is similar to the construction of the FIGS. 6A-7 configuration. However, the end closures 48, 50 are designed for accepting fasteners used to clamp onto the mandrel 64.

Figure 10A:
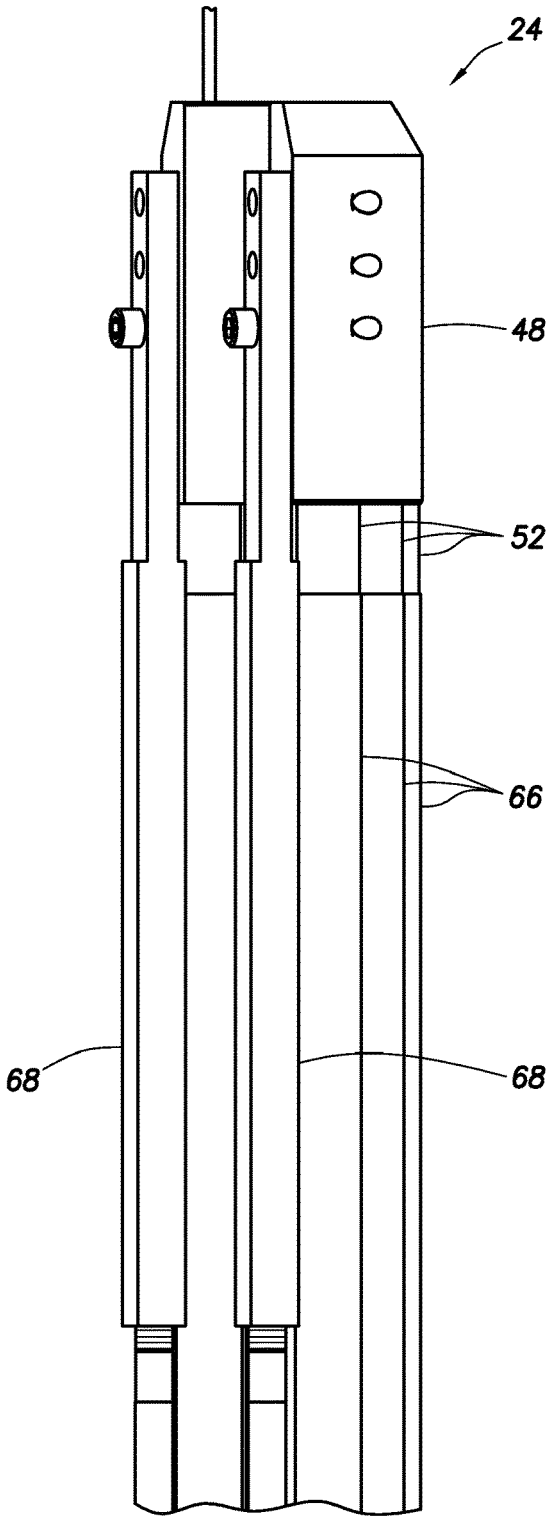
FIGS. 10A & B are representative elevational views of the pressure equalization apparatus of FIG. 8.
Figure 10B:
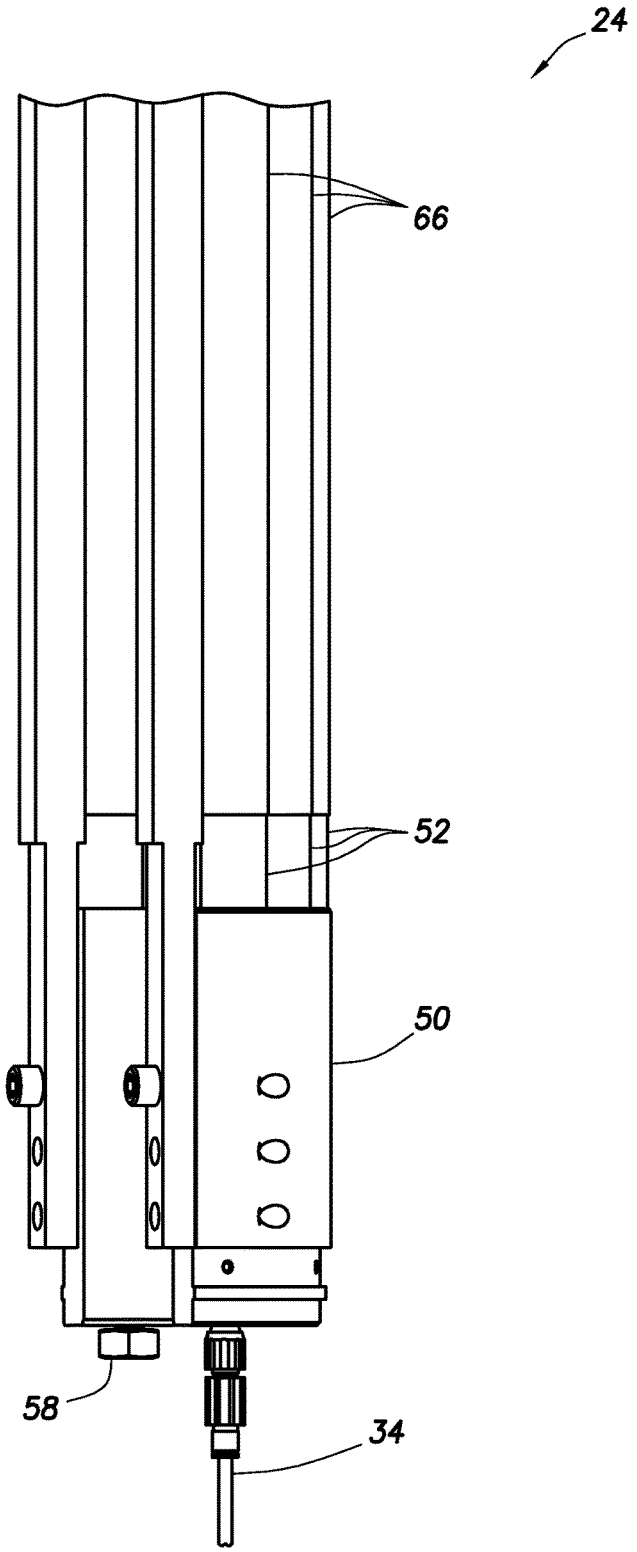

In FIGS. 10A & B, the end closures 48, 50, tubes 66 and connectors 52 are depicted in side views. In these views it may be seen that retainers 68 are fastened to the end closures 48, 50, so that the end closures, along with the tubes 66 and connectors 52, can be attached to the mandrel 64 as a unit.

Figure 11A:
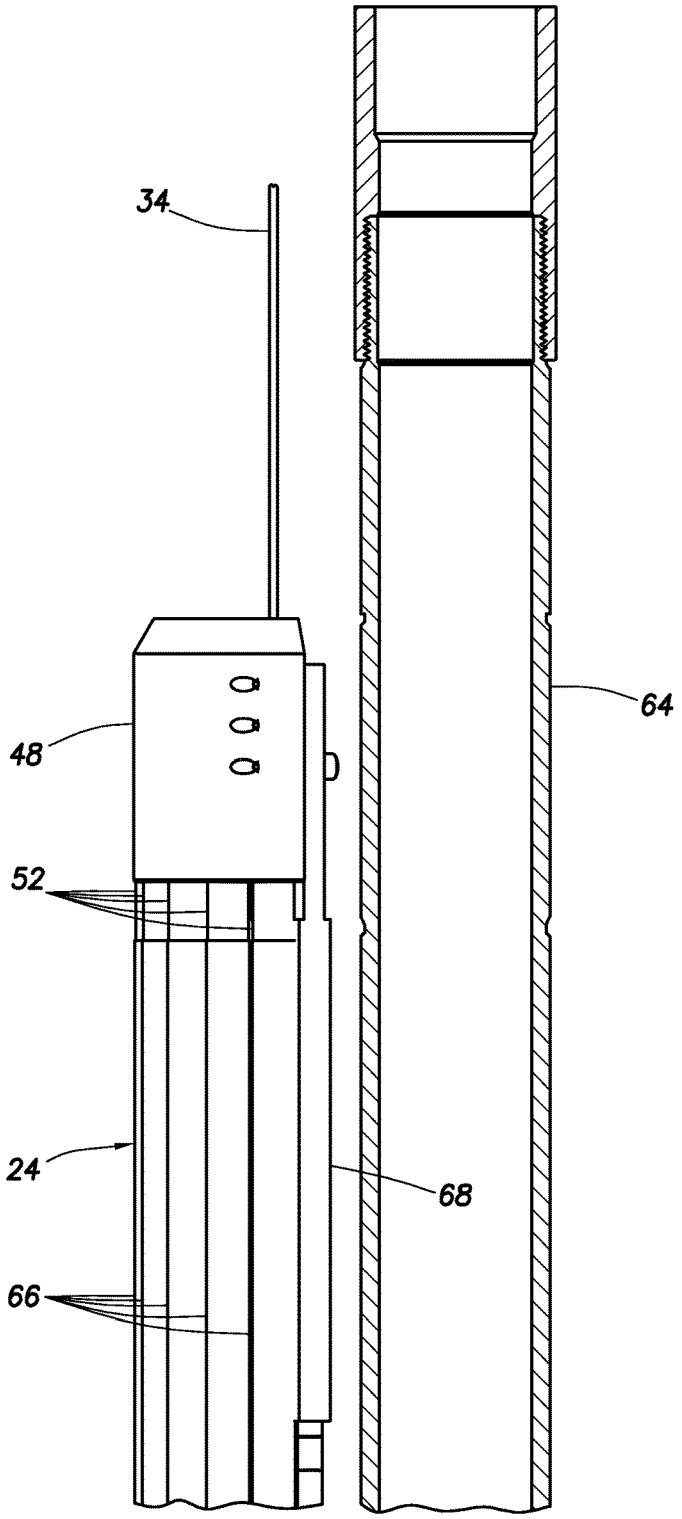
FIGS. 11A & B are representative elevational views of the pressure equalization apparatus of FIG. 8 and a mandrel cross-section.
Figure 11B:
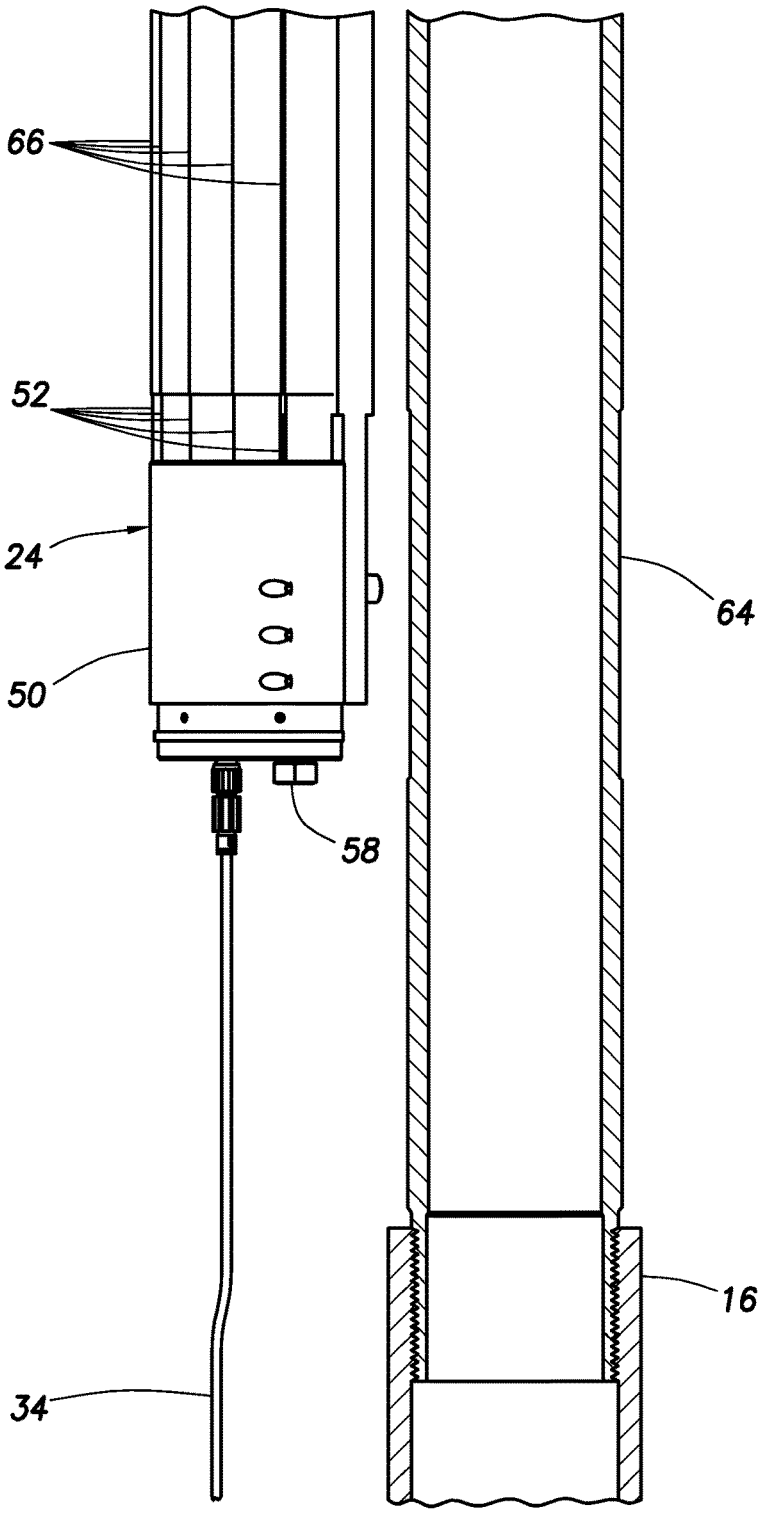

In FIGS. 11A & B, the end closures 48, 50, tubes 66 and connectors 52 are depicted as they are being attached to an outer side of the mandrel 64. In this manner, the mandrel 64 can be used as a handling sub to raise, suspend and convey the well tool 16 into a well.

Preferably, the mandrel 64 would be connected to the well tool 16 (e.g., by threading a lower end of the mandrel into an upper end of the well tool), and the mandrel would be used to raise the well tool into position (e.g., in a rig derrick) above the wellbore 14, and the mandrel would then be used to lower the well tool at least partially into the well.

The pressure equalization apparatus 24 can then be attached to the mandrel 64, and the end 36 of the flowpath 30 can be connected to the chamber 20 in the well tool 16. The retainers 68 could remain on the apparatus 24 when it is installed in the well, or the retainers could be removed after the apparatus is attached to the mandrel 64.

It may now be fully appreciated that the above disclosure provides significant improvements to the art of constructing pressure equalizing systems for use in wells. The pressure equalization apparatus 24 described above quickly equalizes pressure between the chamber 20 and a source of the fluid 28, thereby minimizing any pressure differentials, and provides a large volume of the fluid 26, while preventing the fluid 28 from migrating into the chamber.

The above disclosure describes a well system 10 which can include a well tool 16 with a chamber 20 therein containing an assembly 38, 43 in a dielectric first fluid 26. A pressure equalization apparatus 24 can include a flowpath 30 having first and second opposite ends 34, 36, the first end 34 being connected to the chamber 20, the second end 36 being connected to a source of a second fluid 28, and the flowpath 30 extending in alternating opposite directions between the first and second ends 34, 36 through multiple separate bores 44.

The bores 44 may be formed in tubes 66.

The bores 44 may be circumferentially spaced apart.

The flowpath 30 may extend alternately upward and downward in respective successive ones of the bores 44.

The bores 44 may be formed through respective multiple tubes 66 which extend at least partially circumferentially about a mandrel 64. The tubes 66 may be clamped to the mandrel 64, the mandrel 64 may be attached to the well tool 16, and the well tool 16 may comprise a safety valve.

The second fluid 28 source could comprise an interior longitudinal passage of a tubular string, and/or an annulus between the tubular string and a wellbore. The second fluid 28 may enter the second end 36 of the flowpath 30, but is prevented from flowing to the first end 34 of the flowpath 30. A density of the first fluid 26 can be different from a density of the second fluid 28.

Adjacent pairs of the bores 44 can be in communication with each other.

The assembly may comprise an electrical assembly 38 and/or a mechanical assembly 43.

The above disclosure also describes a pressure equalization apparatus 24 for use with a well tool 16 in a subterranean well. The apparatus 24 can include multiple separate longitudinally extending bores 44 which form a continuous flowpath 30, the flowpath 30 alternating direction between the bores 44, and the bores 44 being interconnected at opposite ends thereof.

The apparatus 24 can include a filter 56 which filters the second fluid 28, and a rupture disc 58 exposed to the flowpath 30 between the filter 56 and the first end 34 of the flowpath 30.

A method of installing a well tool 16 in a well is described above. The method can include attaching a mandrel 64 to the well tool 16, then lowering the well tool 16 at least partially into the well suspended from the mandrel 64, and then securing a pressure equalization apparatus 24 to the mandrel 64, a flowpath 30 of the apparatus 24 being connected to a chamber 20 of the well tool 16 containing an assembly 38, 43.

The method can include increasing pressure in the well, thereby opening the bores 44 to communication with the source of the second fluid 28.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a well tool including a chamber therein containing an assembly in a dielectric first fluid;

a pressure equalization apparatus including a flowpath having first and second opposite ends, the first end being connected to the chamber, the second end being connected to a source of a second fluid, the flowpath extending in alternating opposite directions between the first and second ends through multiple separate bores, wherein the multiple bores include at least first and second bores; and at least one end closure connecting an end of the first bore to an adjacent end of the second bore, wherein the flow path prevents migration of fluid through the flowpath while permitting pressure communication through the flowpath.

2. The system of claim 1, wherein the bores are formed in tubes.

3. The system of claim 1, wherein the bores are circumferentially spaced apart.

4. The system of claim 1, wherein the flowpath extends alternately upward and downward in respective successive ones of the bores.

5. The system of claim 1, wherein the bores are formed through respective multiple tubes which extend at least partially circumferentially about a mandrel.

6. The system of claim 5, wherein the tubes are clamped to the mandrel, and wherein the mandrel is attached to the well tool.

7. The system of claim 1, wherein the second fluid source comprises at least one of an interior longitudinal passage of a tubular string, and an annulus between the tubular string and a wellbore.

8. The system of claim 1, wherein the second fluid enters the second end of the flowpath, but is prevented from flowing to the first end of the flowpath.

9. The system of claim 1, wherein the well tool comprises a safety valve.

10. The system of claim 1, wherein a density of the first fluid is different from a density of the second fluid.

11. The system of claim 1, wherein adjacent pairs of the bores are in communication with each other.

12. The system of claim 1, wherein the assembly comprises an electrical assembly.

13. The system of claim 1, wherein the assembly comprises a mechanical assembly.

14. The system of claim 1 wherein the flowpath includes a conduit, and wherein a line extends through the conduit into the chamber of the well tool.

15. The system of claim 1, wherein the flowpath passes through at least one tube within at least one of the bores.

* * * * *